US005655190A

United States Patent [19]

Fuchiwaki

[11] Patent Number: 5,655,190

[45] Date of Patent: Aug. 5, 1997

[54] ROTARY DEVELOPING EQUIPMENT SWITCHING APPARATUS

[75] Inventor: Takashi Fuchiwaki, Ebina, Japan

[73] Assignee: Fuji Xerox Co., Ltd., Tokyo, Japan

[21] Appl. No.: 624,805

[22] Filed: Mar. 27, 1996

[30] Foreign Application Priority Data

Mar. 30, 1995 [JP] Japan ..... 7-073558
Feb. 28, 1996 [JP] Japan ..... 8-041781

[51] Int. Cl.[6] ..... G03G 15/01
[52] U.S. Cl. ..... 399/227
[58] Field of Search ..... 355/245, 326 R, 355/327; 118/645; 399/227

[56] References Cited

U.S. PATENT DOCUMENTS 4,030,445 6/1977 Takenaga et al. ..... 118/645
4,615,612 10/1986 Ohno et al. ..... 355/245
5,471,292 11/1995 Okazawa ..... 355/326 R

FOREIGN PATENT DOCUMENTS

B2-2-13304 4/1990 Japan .

*Primary Examiner*—Joan H. Pendegrass
*Attorney, Agent, or Firm*—Oliff & Berridge

[57] ABSTRACT

A developing-equipment switching apparatus is provided with a rotary retainer 23 for holding a plurality of developing implements 23, a driving motor 24, control means 28 for controlling the rotation of the driving motor 24, a primary drive transmission member 25 which is anchored to the rotary shaft 24*a* of the driving motor, and a secondary drive transmission member 23*b* which is anchored to the rotary retainer 23, so that the developing implements 21 are switched from one to another by transmitting the torque of the driving motor 24 to the rotary retainer 23 via the primary drive transmission member 25 and the secondary drive transmission member 23*b* to rotate the rotary retainer, wherein the control means 28 causes the driving motor 24 to rotate every integral number of times and sets the rotational ratio between the primary drive transmission member 25 and the secondary drive transmission member 23*b* in such a way that the rotary retainer 23 rotates by a set angle between the adjoining developing implements 21 when the driving motor 24 is rotated the integral number of times.

7 Claims, 7 Drawing Sheets

ROTARY DEVELOPING EQUIPMENT SWITCHING APPARATUS

BACKGROUND OF THE INVENTION

1. Field of the Invention

The present invention relates to a developing-equipment switching apparatus utilized in an electrophotographic color image forming apparatus having a plurality of developing implements such as a color copying machine, a color printer and the like and more particularly to a developing-equipment switching apparatus for switching developing implements from one to another in an image forming apparatus for forming color images by switching the developing implements facing a latent image carrier such as a photosensitive drum from one to another so as to form a toner image of each color.

2. Description of the Related Art

Electrophotographic color image forming apparatus have increasingly been made compact now. For this reason, the tendency is for, in place of the conventional fixed type developing apparatus, a so-called moving developing apparatus to be adopted, the developing apparatus being adapted to switching developing implements facing such a latent image carrier by making a moving member set adjacent to the latent image carrier hold a plurality of developing implements and moving the moving member. Moreover, it has also been proposed to employ a rotary retainer capable of rotation so as to switch developing implements and a linear moving member capable of linear movement so as to switch developing implements.

In the image forming apparatus for switching developing implements like that in comparison with the image forming apparatus provided with a plurality of developing implements around a latent image carrier, the number of members arranged around the latent image carrier is reducible, so that not only the whole apparatus but also the latent image carrier itself can be downsized. Since all the developing implements face the latent image carrier at the same position, moreover, the advantage is that a signal for controlling the operation of the developing implement, for example, a signal for controlling developing bias application timing and such a member as a magnetic roll can be set for common use.

As Japanese Patent Examined Publication No. Hei 2-13304 discloses, a conventional developing-implement switching apparatus of the sort mentined above comprises a rotatably-supported rotary retainer for holding four developing implements in such a way as to make each of the developing implements face a latent image carrier when the rotary retainer rotates, a driving motor for generating driving force, control means for controlling the rotation of the driving motor, a primary gear anchored to the rotary shaft of the driving motor and rotated together with the rotary shaft, and a secondary gear fitted to the rotary retainer and rotated together with the rotary retainer, wherein the rotary retainer is rotated by transmitting the torque of the driving motor to the rotary retainer via the primary and secondary gears, whereby the developing implements facing the latent image carrier are switched from one to another.

In order to equalize the developing conditions of all the developing implements in the aforesaid developing-equipment switching apparatus, each of the developing implements needs positioning precisely. Therefore, the target value of the rotational rate of the rotary retainer in accordance with the space between developing implements to be rotated and simultaneously the rotary shaft of the driving motor is fitted with an encoder whose rotation is read by a detection means. Further, the rotational rate of the rotary retainer is calculated on the basis of intervals at which the codes of the encoder are generated and the driving motor is controlled so that the calculated rate conforms to the aforementioned target value.

The encoder is supplied with a plurality of marks disposed in the rotational direction thereof and the detection means generates a code each time the mark arrives at a proper facing position.

Notwithstanding, the target value of the rotational rate of the rotary retainer has to be classified into those at the time of acceleration, constant rate operation and reduction to actualize the control operation above, which has the control operation complicated. In addition, the developing-equipment switching apparatus tends to become complicated in construction and thus costly because it needs a large capacity memory for storing the rates, an encoder, a detection means, a timer, a rate counter, a control CPU and the like.

SUMMARY OF THE INVENTION

The present invention has been made in view of the above circumstances, and therefore an object of the present invention is to provide a developing-equipment switching apparatus capable of switching developing implements quickly and simply under control and precisely positioning developing implements.

In order to solve the above problem, a developing-equipment switching apparatus according to the present invention comprises: a rotatably-supported rotary retainer for holding a plurality of developing implements in such a way as to make each developing implement face a latent image carrier when the rotary retainer rotates, a driving motor for generating driving force, control means for controlling the rotation of the driving motor, a primary drive transmission member which is anchored to the rotary shaft of the driving motor and rotated with the rotary shaft, and a secondary drive transmission member which is anchored to and rotated with the rotary retainer, so that the developing implements are switched from one to another by transmitting the torque of the driving motor to the rotary retainer via the primary drive transmission member and the secondary drive transmission member so as to rotate the rotary retainer, wherein the control means causes the driving motor to rotate every integral number of times and sets the rotational ratio between the primary drive transmission member and the secondary drive transmission member in such a way that the rotary retainer rotates by a set angle between the adjoining developing implements when the driving motor is rotated the integral number of times.

According to the present invention, the rotary retainer is rotatably supported and adapted only to holding the plurality of developing implements in such a way that each developing implement faces the latent image carrier when the rotary retainer rotates. The rotary retainer may be formed of a pair of flat discoidal plates and hold the plurality of developing implements therebetween.

The driving motor has a stator and a rotor whose rotary shaft is fixed and may be a stepping motor, for example, which generates driving force and adapted to stopping each time it turns once.

The primary drive transmission member and the secondary drive transmission member may be gears, pulleys, chain gears and the like and such that they rotate as the driving motor rotates and that the secondary drive transmission member is rotated when the primary drive transmission member rotates. In cases where the primary and secondary drive transmission members are gears, the gears only need meshing with each other, where they are pulleys, a belt needs stretching therebetween and where they are chain gears, a chain needs stretching therebetween. Even when the primary and secondary drive transmission members are arranged so that the torque is directly transmitted thereto, it is only needed for the torque to be transmitted from the primary drive transmission member via an idle drive transmission member such as an idle pulley to the secondary drive transmission member.

In a case where the secondary drive transmission member is in the form of a gear and the rotary retainer is in the form of a flat discoidal plate, the former and the latter are integrally formed by directly cutting a plurality of teeth in the peripheral portion of the latter, whereby the work of properly positioning the developing implement and the gear can be dispensed with and besides the positional relationship between the developing implement and the gear are properly set with accuracy. Thus the developing implement is suppressed from positionally deviating from the gear teeth and an error in the stopping positions of the developing implements becomes reducible.

The rotational ratio between the primary drive transmission member and the secondary drive transmission member may be set so that the rotary retainer rotates by a set angle between the adjoining developing implements when the driving motor is rotated the integral number of times. In a case where k pieces of developing implements are fitted to the rotary retainer at intervals of set angles and where gears are used as the primary and secondary drive transmission members, for example, the rotational ratio between the primary drive transmission member and the secondary drive transmission member may be set to satisfy the following relationship:

$$b=nka \ (n=integer) \quad (1)$$

where a=the number of teeth of the primary gear; and b=the number of teeth of the secondary gear.

The control means above may be what is capable of rotating the driving motor the integral number of times. For example, the control means may be adapted to rotating the driving motor in line with the position of a developing implement to be subsequently used (i.e., every n×m (m=integer) rotations in Expression (1) even though it is designed to rotate the driving motor always the same number of times (i.e., every n rotations in Expression (1).

Further, the above developing-equipment switching apparatus is provided with a first rotation detecting means for detecting the rotation of the rotary retainer each time the rotary retainer turns once and the control means controls the driving motor with a predetermined control sequence in the state in which the first rotation detecting means has detected the rotation thereof as a reference state to ensure that the desired developing implement is made to face the latent image carrier with ease. In a case where the image forming apparatus is adapted to forming a full color image and a monochromatic image, further, a plurality of color modes corresponding to the respective operations is provided. Simultaneously, the control means is stored with a plurality of control sequences corresponding to the respective color modes of the image forming apparatus and caused to execute a proper control sequence out of those stored therein.

In the developing-equipment switching apparatus, further, the first rotation detecting means for detecting the rotation of the rotary retainer each time the rotary retainer turns once and a second rotation detecting means for detecting the rotation of the driving motor each time the driving motor turns once are provided and simultaneously used for deciding whether or not the detection signals of these two rotation detecting means are in predetermined relationship with each other, whereby it is possible to detect simply and readily the inconsistent operation of the developing-equipment switching apparatus, that is, to execute the inconsistent-time sequence.

Although the inconsistent-time sequence may be arranged so that the apparatus is shut down immediately after the inconsistency is detected, if the control means is so actuated as to stop the driving motor in such a state that the first rotation detecting means has detected the rotation of the rotary retainer, the driving motor will be reset and made to operate properly even when the detection signals of the two rotation detecting means happened to have deviated from the predetermined relationship.

The developing implement according to the present invention can be properly positioned at the time the rotation of the driving motor is stopped. However, a stopper member for absorbing the rotation of the rotary retainer in addition to the rotary retainer may be used in a case where the rotary retainer is heavy or rotated at high speed.

Since the rotational ratio between the primary drive transmission member and the secondary drive transmission member is set so that the rotary retainer rotates by a set angle between the adjoining developing implements when the driving motor is rotated the integral number of times, the developing implements facing the latent image carrier can be switched from one to another by letting the control means so control the driving motor as to rotate it every integral number of times. Further, the rotational ratio between the primary and secondary drive transmission members is set in such a way that the rotary retainer rotates by the set angle of the developing implement adjacent to a position in the reference state when the driving motor rotates the integral number of times.

While any one of the developing implements is facing the latent image carrier, the rotor of the driving motor stands in the same relationship to the stator since the control means in the developing-equipment switching apparatus according to the present invention switches the developing implements facing the latent image carrier while rotating the driving motor every integral number of times.

BRIEF DESCRIPTION OF THE DRAWINGS

The above and other objects and features of the present invention will be more apparent from the following description taken in conjunction with the accompanying drawings.

DETAILED DESCRIPTION OF THE PREFERRED EMBODIMENTS

A description will subsequently be given of an embodiment of the present invention by reference to the accompanying drawings.

Embodiment 1

Figure 1:
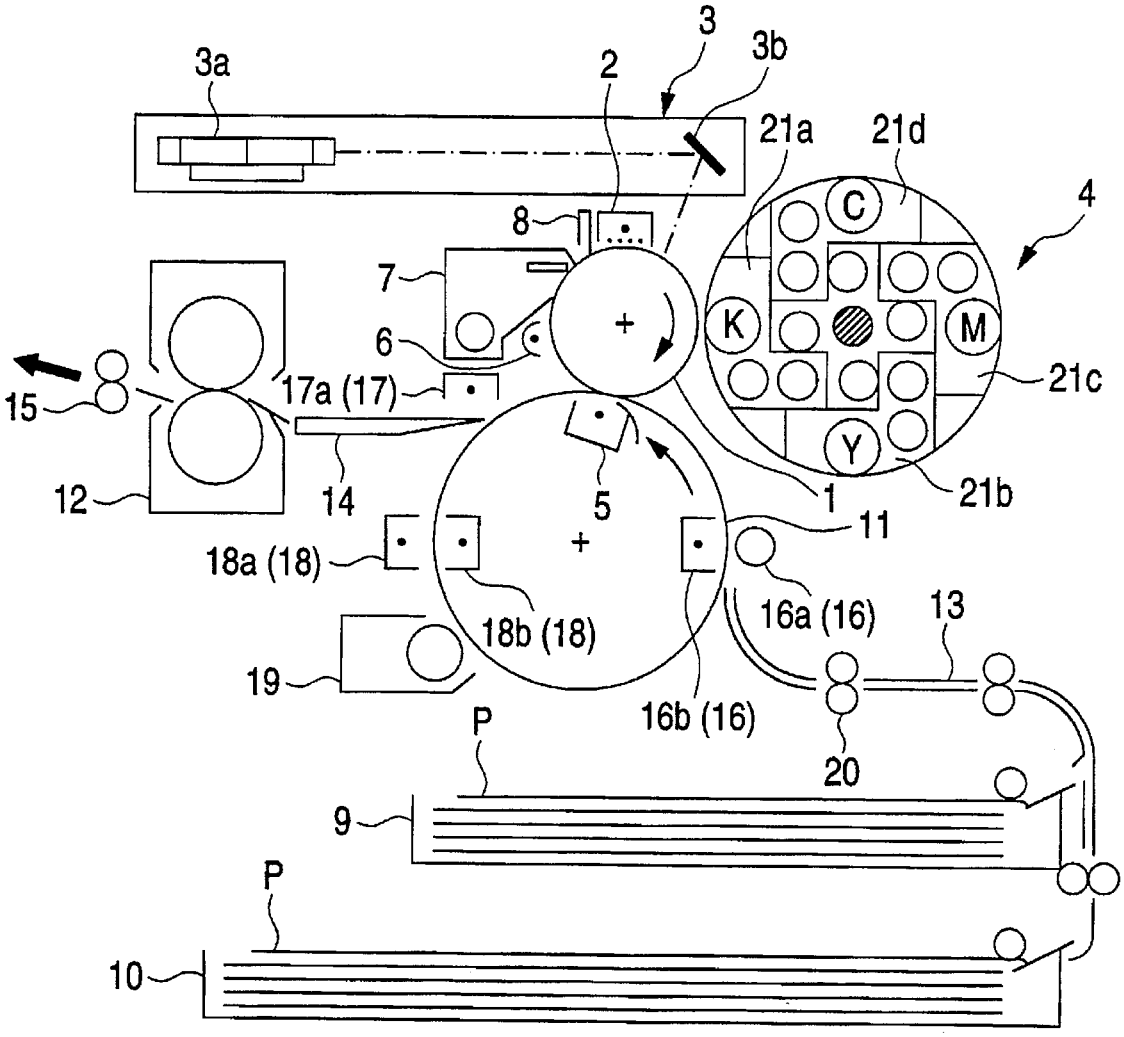
FIG. 1 is a block diagram showing the principal part of a full color printer using a developing-equipment switching apparatus according to an embodiment 1 of the present invention.

FIG. 1 shows an electrophotographic full color printer using a developing-equipment switching apparatus embodying the present invention.

The full color printer has a toner image forming unit for forming a toner image of each color, and a sheet conveying unit for conveying a recording sheet so as to superimpose the toner image on the recording sheet.

As shown in FIG. 1, the toner image forming unit comprises a photosensitive drum 1 on which a toner image is formed, a uniform charger 2 for negatively charging the peripheral face of the drum, a laser exposure unit 3 for exposing the peripheral face of the drum with a laser beam with image information superimposed thereon so as to form a latent image, a developing unit 4 for developing the latent image using toner, a transfer charger 5 for transferring the toner image onto a recording sheet P, a charge eliminator 6 for removing the toner charge left on the peripheral face prior to cleaning, a photosensitive drum cleaning unit 7 for removing the residual toner from the peripheral face, and a photosensitive-drum charge eliminator 8 for totally removing the charge from the peripheral face of the photosensitive drum.

Further, the sheet conveying unit comprises paper trays 9, 10 for accommodating many recording sheets P differently sized, a transfer drum 11 placed between the photosensitive drum 1 and the transfer charger 5, the recording sheet P being made to stick to the peripheral face of the drum, a fixing unit 12 for fixing the toner image thus transferred onto the recording sheet P, a sheet input channel 13 for use in conveying the recording sheet P from the paper trays 9, 10 to the transfer drum 11, a conveyer guide 14 for conveying the recording sheet P from the transfer drum 11 to the fixing unit 12, output rolls 15 for discharging the recording sheet P out of the printer via the fixing unit 12, an attraction member 16 for attracting the recording sheet P to the transfer drum 11, a peeling member 17 for peeling the recording sheet P off the peripheral face of the transfer drum 11, a transfer-drum charge-eliminating member 18 for totally removing the charge on the peripheral face of the transfer drum 11, and a transfer drum cleaning unit 19 for cleaning the peripheral face of the transfer drum 11. Further, registration rolls 20 for regulating the timing at which the recording sheet P is supplied to the transfer drum 11, the registration rolls 20 being disposed along the sheet input channel.

The laser exposure unit 3 of the toner image forming unit has a laser emitting element (not shown) for emitting laser beams in response to an electric signal on which image information has been superimposed, a polygon mirror **3*a* for dividing the laser beams on a one-scanning basis, and a mirror 3*b* for reflecting the laser beam for one scanning in the direction of the photosensitive drum 1**.

The attraction member 16 of the sheet conveying unit has an attraction roll 16 abutting against the peripheral face of the transfer drum 11 and an attraction charger **16*b* placed opposite to the attraction roll 16*a* with the transfer drum 11 held therebetween. The peeling member 17 has a peeling electrostatic eliminator 17*a* for removing the charge of the recording sheet P and a peeling finger (not shown) fitted to the leading end of the conveyer guide on the transfer drum side. Further, the transfer-drum charge-eliminating member 18 has a pair of charge eliminators 18*a* and 18*b***.

The developing unit 4 has four developing implements **21*a*, 2l*b*, 21*c* and 21*d* in a two-component system each containing black, yellow, magenta and cyan toners, and a developing-implement switching unit 22** for holding these developers in such a way as to make the them successively face the photosensitive drum.

Figure 2:
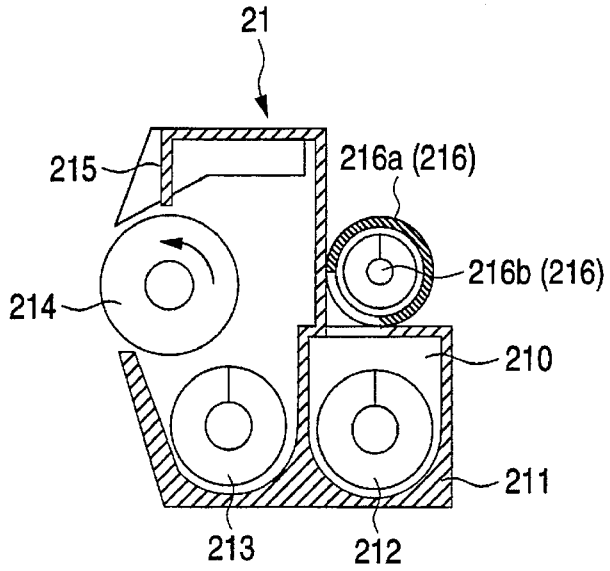
FIG. 2 is a cross-sectional view showing a developing implement loaded with the developing-equipment switching apparatus according to the embodiment 1 of the present invention.
Figure 3:
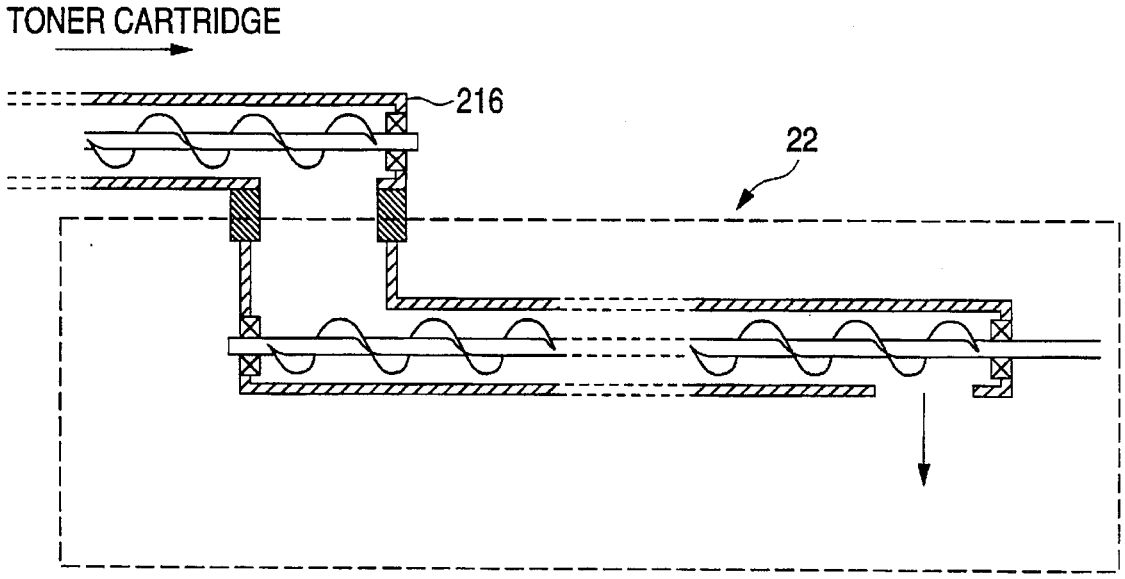
FIG. 3 is a schematic diagram showing a toner supply member mounted on the developing-equipment switching apparatus.

As shown in FIG. 2, the developing implement 21 in the two-component system has a housing 211 having a developing-agent stirring chamber 210 for use in mixing toner and carrier; a pair of developing-agent stirring/mixing members 212 and 213 for respectively stirring the developing agent in opposite directions, the developing-agent stirring/mixing members 212 and 213 being rotatably disposed in the developing-agent stirring chamber 210; a developing roll 214 including a magnetic roll and a sleeve, the developing roll 214 being placed above the developing-agent stirring chamber 210; a layer-thickness regulating member 215 for regulating the thickness of a developing agent layer on the sleeve, the layer-thickness regulating member 215 being located opposite to the sleeve; a toner cartridge (not shown) for accommodating a large quantity of toner; and a toner supplying member 216 for supplying toner from the toner cartridge to the developing-agent stirring chamber 210, the toner supplying member 216 having a conveying tube **216*a* and a spiral conveying member 216*b*. The toner is supplied to the developing-agent stirring chamber 210, mixed with the carrier in the pair of developing-agent stirring/mixing members 212, 213 and attracted by the magnetic force of the magnetic roll before being made to stick onto the sleeve for developing purposes. Moreover, the developing agent that has not been used for development is peeled off the sleeve by the magnetic force of the magnetic roll after it is returned to the housing 211**.

Further, the conveying rate of the pair of developing-agent stirring/mixing members 212, 213 in the developing implement 21 is utilized for setting most suitable the circulating rate of the development agent, the magnetic force of the magnetic roll for attracting the developing agent and that of the magnetic roll for peeling off the developing agent so that the concentration of the toner image used for a full color image is stabilized. As shown in FIG. 13 on the other hand, the spiral conveying member **216*b* is rotated at such a high speed as to send back the developing agent that has flowed backward to the developing-agent stirring chamber 210 to prevent the backflow of the developing agent from the developing-agent stirring chamber 210 to the toner cartridge to ensure that the toner is supplied newly. Moreover, the housing 211 and the toner supply member 216 are independently secured to the developing-implement switching unit 22 so as to suppress the vibration caused by the rotation of the spiral conveying member 216*b* from being directly transmitted to the housing 211**.

Figure 4:
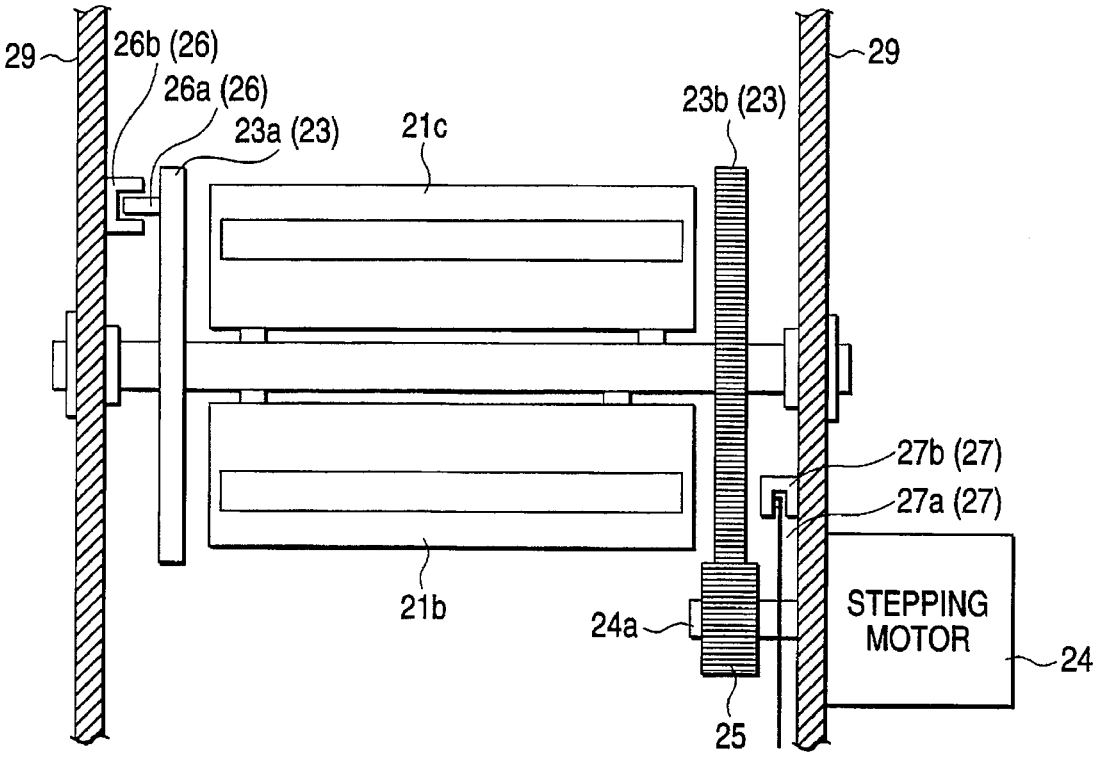
FIG. 4 is a block diagram of the developing-equipment switching apparatus according to the embodiment 1 of the present invention.

The developing-implement switching unit 22 has, as shown in FIG. 4, a rotary retainer 23 which has a pair of discoidal flat plates 23*a*, 23*b* and holds the four developing implements 21 at every 90° in the order of black, yellow, magenta and cyan; a stepping motor 24 for generating driving force; a primary gear which has 14 teeth, anchored to the rotary shaft 24*a* of the stepping motor 24 and rotated together with the rotary shaft 24*a* thereof; first rotation detecting means 26 for detecting the rotation of the rotary retainer 23 per turn; second rotation detecting means 27 for detecting the rotation of the rotary shaft 24*a* of the stepping motor 24 per turn; an inconsistent-operation detecting means 30 for outputting an inconsistency detecting signal on receiving detection signals from the respective first and second rotation detecting means 26 and 27 when the two detection signals are not received at predetermined input timing; and a control means 28 for controlling the rotation of the stepping motor 24 in response to the detection signal from the first rotation detecting means 26 and a color mode signal on one hand, and executing a predetermined inconsistent-time sequence on receiving the inconsistency detecting signal on the other, the whole being secured to the main frame of the printer.

The one flat plate 23*b* (hereinafter called the "secondary gear plate 23*b*") of the rotary retainer 23 is a steel plate 2.6–3 mm thick and has a plurality of teeth are formed in the peripheral portion by direct cutting and hardening, the primary gear 25 directly meshing with the flat plate 23*b*. Therefore, the work of properly positioning the developing implement 21 and the teeth of the secondary gear plate 23*b* becomes unnecessary and also the positional relationship between the teeth and each developing implement 21 can be established with accuracy. Consequently, it is possible to decrease not only the deviation of the position of the developing implement from the teeth but also an error in the stopping positions of the developing implements 21.

Further, 112 (2×4×14) teeth are provided by cutting for the secondary gear plate 23*b* so that rotary retainer 23 turns by 45° each time the stepping motor 24 turns once, wherein numeral 14 denotes the number of teeth of the primary gear 25; 4, the number of developing implements; and 2, the value obtained by dividing 90° by 45° , the 90° being an angle at which the developing implements are arranged.

Figure 5:
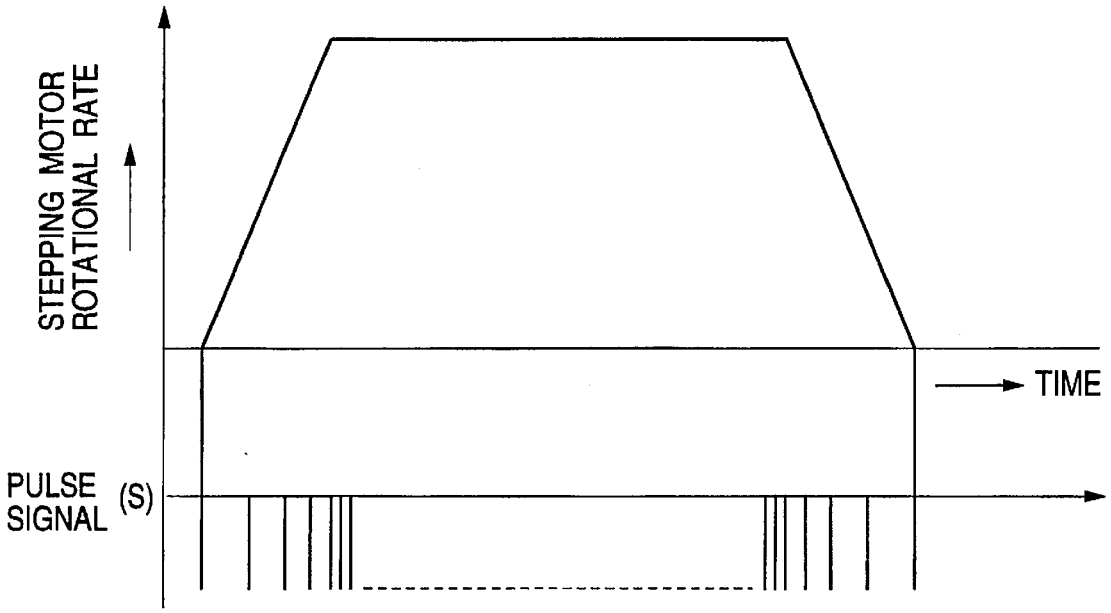
FIG. 5 is a graph representing an operating characteristic of a stepping motor.
Figure 6:
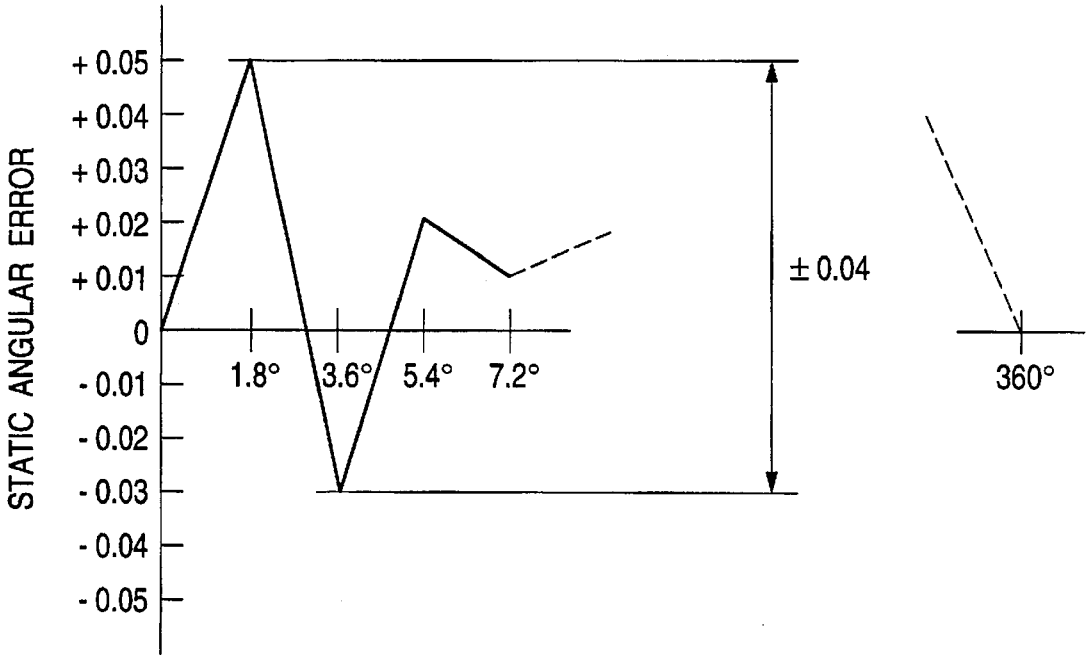
FIG. 6 is a graph representing a static angular error characteristic of the stepping motor.

As shown in FIG. 5, the stepping motor 24 rotates at a rate proportional to the frequency of an input pulse; that is, it rotates by an angle precisely proportional to the number of pulses. In this case, a stop angle of 1.8° can be set for the stepping motor 24 (i.e., it is turned by 360° at 200 pulses) according to this embodiment of the invention as shown in FIG. 6. Since the stepping motor 24 admits a subtle static angular error resulting from variations in the mechanical precision of teeth in the stator and rotor of the stepping motor 24 and in the d.c. resistance value of the stator winding, the static angular error at any stop position remains at ±0.04. On the other hand, such a static angular error is 0° when the stepping motor 24 turns 360° as the same teeth of the stator and rotor and the same stator winding of the stepping motor 24 are used.

The first rotation detecting means 26 has a projection 26*a* projected from the side of the other flat plate 23*a* of the rotary retainer 23 and placed at a position of 45° between the developing implement 21*a* containing black toner and the developing implement 21*d* containing cyan toner, and a first detection member 26*b* which has a light emitting and a light receiving element and is placed so that the projection 26*a* is made to pass between the elements each time the rotary retainer 23 turns once.

According to this embodiment of the invention, moreover, the first detection member 26*b* is so positioned as to make the position of 45° between the developing implement 21*a* containing the black toner and the developing implement 21*d* containing the cyan toner (hereinafter this position is called the "home position") face the photosensitive drum 1 when the detection signal of the first rotation detecting means 26 is detected.

Therefore, the developing implement 21*a* containing the black toner in the developing unit faces the photosensitive drum 1 when the rotary shaft 24*a* of the stepping motor turns once from the home position; the developing implement 21*b* containing the yellow toner in the developing unit faces the photosensitive drum 1 when the rotary shaft 24*a* of the stepping motor turns three times therefrom; the developing implement 21*c* containing the magenta toner in the developing unit faces the photosensitive drum 1 when the rotary shaft 24*a* of the stepping motor turns five times therefrom; and the developing implement 21*d* containing the cyan toner in the developing unit faces the photosensitive drum 1 when the rotary shaft 24*a* of the stepping motor turns seven times therefrom.

In the developing unit, further, the developing implement 21 facing the photosensitive drum 1 is switched over when the stepping motor 24 turns twice. While any one of the developing implements 21 is .facing the photosensitive drum 1, the stator and rotor of the stepping motor 24 are kept in the same relation with each other, whereby the positional deviation of the developing implement 21 caused by the static angular error of the stepping motor 24 is obviated.

The second rotation detecting means 27 is fitted to the rotary shaft 24*a* of the stepping motor and has a disc 27*a* with a notch formed therein, a light emitting and a light receiving element, and a second detection member 27*b* placed so that the notch is made to pass between the elements each time the rotary shaft 24*a* turns once.

The inconsistent-operation detecting means 30 has a counter 29*a* for outputting a signal once with predetermined delay time on receiving the detection signal of the second rotation detecting means 27 eight times, and a comparator 29*b* for receiving the detection signal of the first detection member 26*b* together with that of the second rotation detecting means 27. The delay time is set to let the comparator 29*b* receive the output signal of the counter 29*a* together with the detection signal of the first rotation detecting means 26, whereas the comparator 29*b* is set to output the inconsistency detecting signal when it does not receive the above two signals. In other words, the developing-implement switching unit 22 according to this embodiment of the invention is capable of operational inconsistency extremely simply with two rotation detecting means 26 and 27 and one comparator 29*b*.

The inconsistency detecting signal is supplied to not only the control means 28 but also a display unit 30 for displaying the fact that the inconsistent operation has been detected. Therefore, the operator decides whether to continue the printing operation on acknowledging the inconsistency and can continue the printing operation even when the inconsistent operation has brought about.

Figure 7:
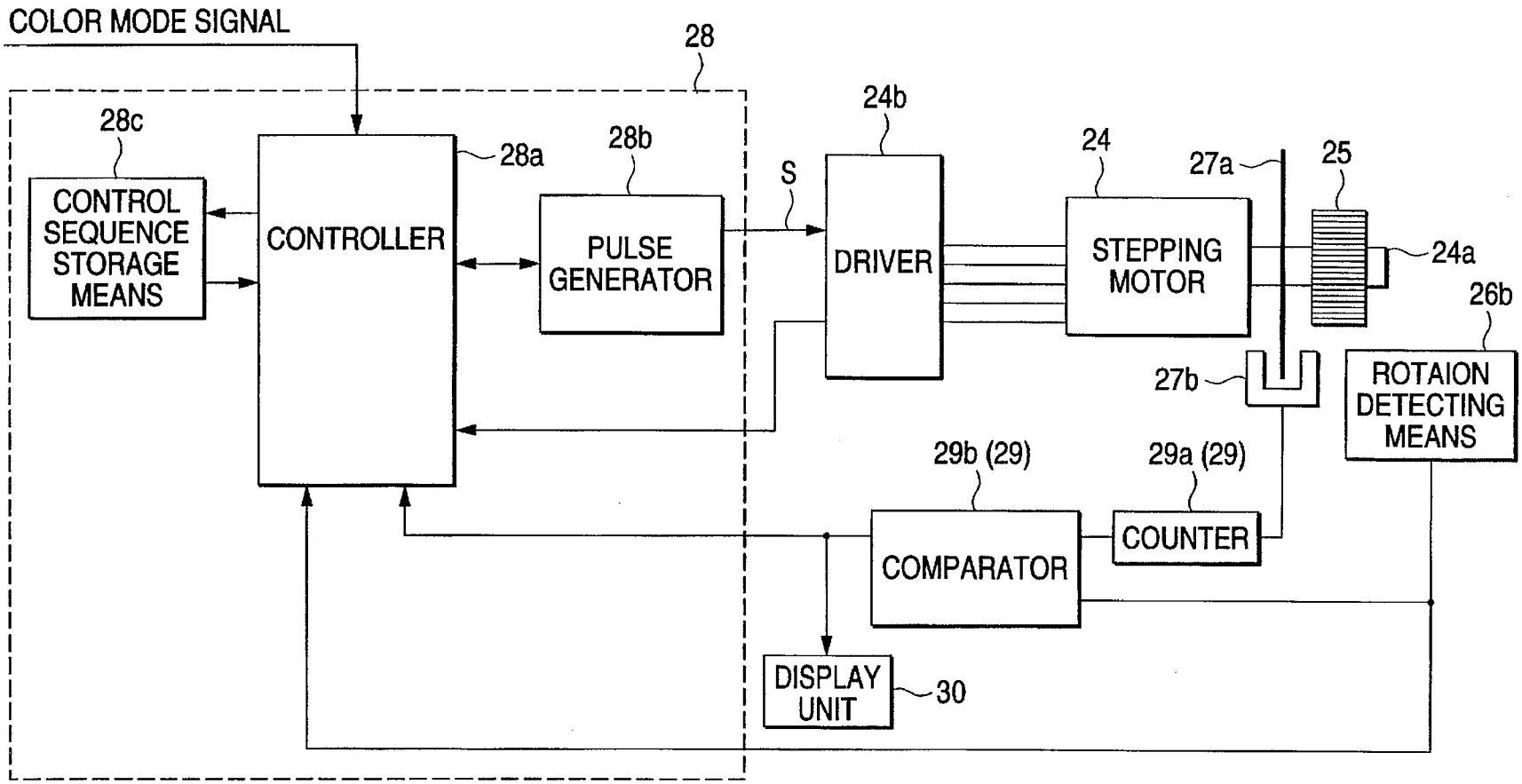
FIG. 7 is a block diagram showing control means in the developing-equipment switching apparatus shown in FIG. 4.
Figure 8:
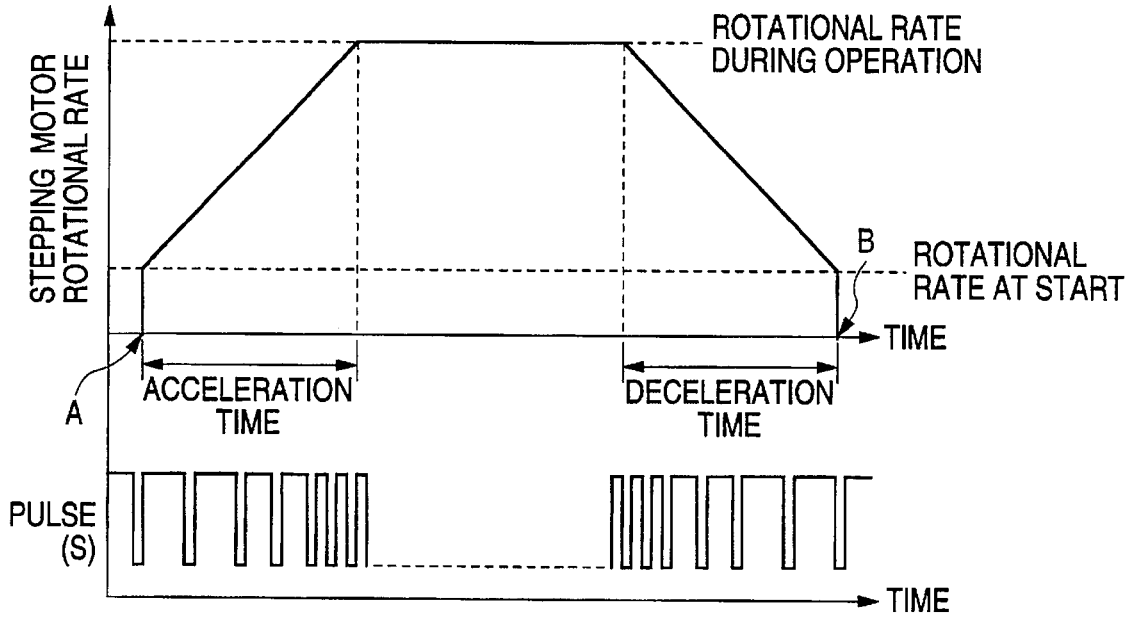
FIG. 8 is a graph representing explanatorily representing the operation of the stepping motor.

As shown in FIG. 7, the control means 28 has a control sequence storage means 28*c* for storing a plurality of control sequences, a controller 28*a* for selecting a predetermined control sequence, sequentially designating control in the control sequence with the presence of the detection signal of the first rotation detecting means 26 and at the time of inconsistency, causing the stepping motor 24 to operate until the first rotation detecting means 26 detects the rotation of the rotary retainer 23, and a pulse generator 28*b* for generating pulses S at predetermined pulses in accordance with the instruction given as shown in FIG. 8. In other words, the developing-implement switching unit, which is simple in construction, is capable of switching any developing implement facing the photosensitive drum 1. Incidentally, reference numeral 24*b* denotes the driver of the stepping motor.

Color modes and control sequences for controlling the rotation of the stepping motor corresponding to the respective color modes as listed in Table 1 are stored in the control sequence storage means 28*c*. Each control sequence exerts control in such a way that one specific developing implement 21 or a plurality of them are caused to face and stop at the photosensitive drum 1 successively from the standstill state at the home position and that the developing implement finally stops at the home position.

TABLE 1

| No. | Color mode: Mode | Color mode: Color | Rotational quantity of rotary retainer | Rotational number of rotor of stepping motor |
|---|---|---|---|---|
| 1 | Mono-chromatic mode | Bk | 45° → 315° | 1 → 7 |
| 2 | Mono-chromatic mode | Y | 135° → 225° | 3 → 5 |
| 3 | Mono-chromatic mode | M | 225° → 135° | 5 → 3 |
| 4 | Mono-chromatic mode | C | 315° → 45° | 7 → 1 |
| 5 | Two-color mode | Bk → Y | 45° → 90° → 225° | 1 → 2 → 5 |
| 6 | Two-color mode | Bk → M | 45° → 180° → 135° | 1 → 4 → 3 |
| 7 | Two-color mode | Bk → C | 45° → 270° → 45° | 1 → 6 → 1 |
| 8 | Two-color mode | Y → M | 135° → 90° → 135° | 3 → 2 → 3 |
| 9 | Two-color mode | Y → C | 135° → 180° → 45° | 3 → 4 → 1 |
| 10 | Two-color mode | M → C | 225° → 90° → 45° | 5 → 2 → 1 |
| 11 | Three-color mode | Y → M → C | 135° → 90° → 90° → 45° | 3 → 2 → 2 → 1 |
| 12 | Four-color mode | Bk → Y → M → C | 45° → 90° → 90° → 90° → 45° | 1 → 2 → 2 → 2 → 1 |

(Bk: black, Y: yellow, M: magenta, C: cyan)

Table 1 shows the color mode, the then rotational quantity of the rotary retainer, and the relationship between the number of rotations of the rotor of the stepping motor. In Table 1, the rotational quantity of the rotary retainer and the number of rotations of the rotor of the stepping motor mean the sequence of the rotational quantity of the rotary retainer and the rotational sequence of the rotor of the stepping motor, respectively. Further, the angle indicated in the rotational quantity of the rotary retainer also means [(rotational angle of the rotary retainer until start of development)→(rotational angle of the rotary retainer up to the home position)] or [(rotational angle of the rotary retainer until start of development)→((rotational angle of the rotary retainer until start of next development)→. . . →(rotational angle of the rotary retainer up to the home position)]. In the column of the number of rotations of the rotor of the stepping motor, the number of rotations of the rotor of the stepping motor needed to actualize the rotational quantity indicated in the column of the rotational quality of the rotary retainer.

A description will subsequently be given of the operation of the printer by taking it as an example of a case where a full color image is formed on a recording sheet. In this case, the control means 28 selects a control sequence corresponding to the four color mode and controls the four developing implements 21 so as to make them stop opposite to the photosensitive drum successively in line with the image forming step.

First, the printer makes the developing implement 21*a* face the photosensitive drum 1 and also rotates the photosensitive drum 1, the developing implement 21*a* containing black toner as a result of which the control means 28 has turned the stepping motor 24 once.

Then the printer forms a black image on the recording sheet P in that state. More specifically, the printer first loads the photosensitive drum 1 with negative charge uniformly by means of the uniform charger 2, makes the laser exposure unit 3 expose the drum to form a latent image in conformity with image information, and develops the latent image using the developing implement 21*a* containing the black toner so as to form a black toner image on the photosensitive drum 1 (the description above refers to a black toner image forming step). On the other hand, the printer causes the recording sheet P to be conveyed up to the position of the registration rolls 20 from the paper trays 9, 10. Lastly, the printer forms the black toner image on the recording sheet P by feeding the recording sheet P from the registration rolls 20 in synchronization with the timing at which the black toner image comes up to the position between the photosensitive drum 1 and the transfer charger 5 (hereinafter called the "transfer position").

While causing the recording sheet P carrying the black toner image to be held on the transfer drum 11, further, the printer makes the developing implement 21*a* face the photosensitive drum 1, the developing implement 21*a* containing yellow toner as a result of which the control means 28 has turned the stepping motor 24 twice, forms a yellow toner image on the photosensitive drum 1 and then forms, by rotating the transfer drum 11, the yellow toner image on the recording sheet P to which the black toner image has been transferred.

While causing the recording sheet P carrying the black and yellow toner images to be held on the transfer drum 11, the printer makes the developing implement 21*a* face the photosensitive drum 1, the developing implement 21*a* containing magenta toner as a result of which the control means 28 has turned the stepping motor 24 twice, forms a magenta toner image on the photosensitive drum 1 and then forms, by rotating the transfer drum 11, the magenta toner image on the recording sheet P to which the black and yellow toner images have been transferred.

While causing the recording sheet P carrying the black, yellow and magenta toner images to be held on the transfer drum 11, the printer makes the developing implement 21*a* face the photosensitive drum 1, the developing implement 21*a* containing cyan toner as a result of which the control means 28 has turned the stepping motor 24 twice, forms a cyan toner image on the photosensitive drum 1 and then forms, by rotating the transfer drum 11, the cyan toner image on the recording sheet P to which the black, yellow and magenta toner images have been transferred.

Lastly, the printer peels the recording sheet P with the multi-color image formed thereon off the transfer drum 11, conveys the recording sheet P to the fixing unit 12 for the purpose of color-fixing, and discharges the recording sheet P out of the printer by means of the output rolls 15. Thus a color image is formed.

When image formation is terminated, the printer sets the developing unit 4 at the home position by letting the control means 28 turn the stepping motor 24 once, whereas when the operation of forming images is continued, the printer makes the developing implement 21*a* containing the black toner face the photosensitive drum 1 by letting the control means 28 turn the stepping motor 24 twice.

At the image forming step, moreover, the photosensitive drum 1 is cleaned by the prior-to-cleaning charge eliminator 6, the photosensitive drum cleaning unit 7 and the photosensitive-drum charge eliminator 8 each time the toner image is transferred thereto. On the other hand, the transfer drum 11 is cleaned by the transfer-drum charge-eliminating member 18 and the transfer-drum cleaning unit 19 each time the recording sheet P is peeled therefrom.

Figure 9:
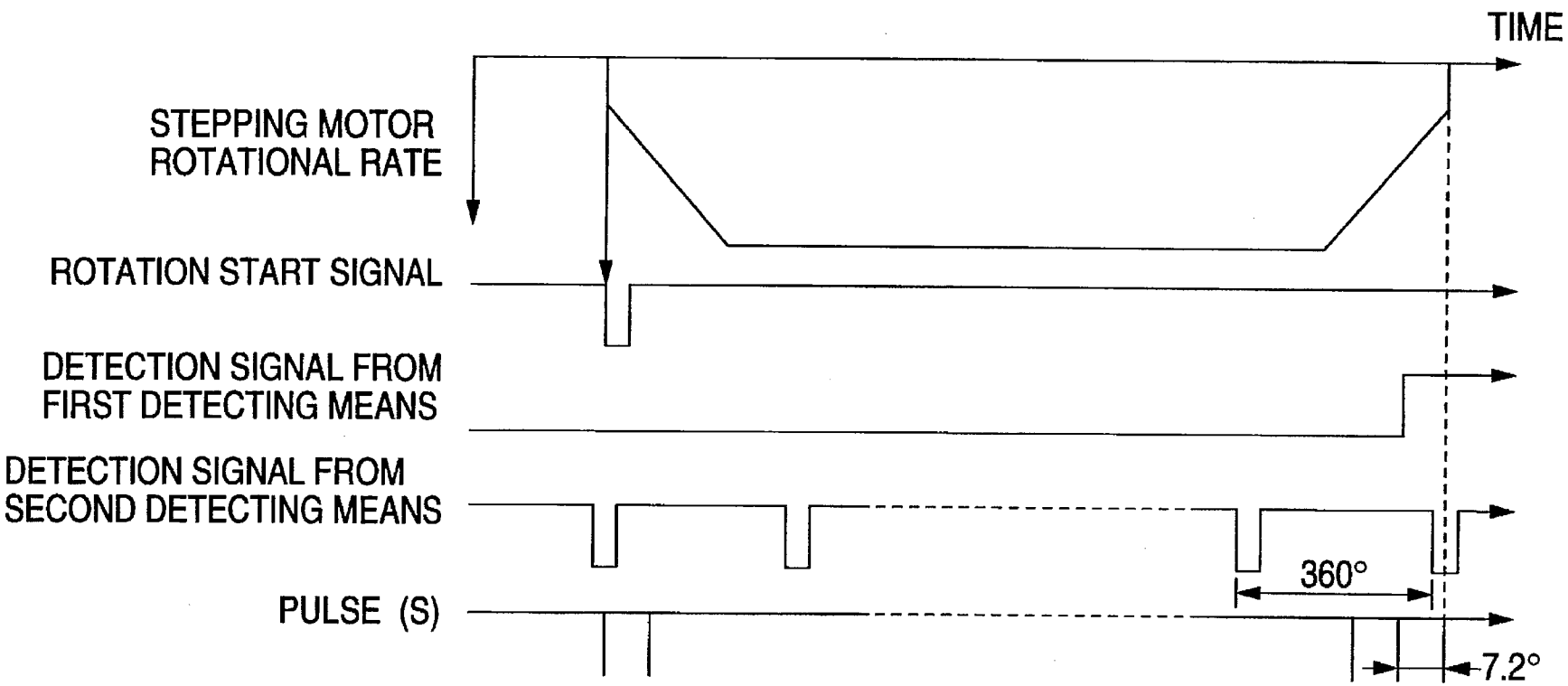
FIG. 9 is a sequence chart illustrating the operating of making a home position face a photosensitive drum.

Even in a case where the position of the developing implement and the home position becomes indistinct when power, for example, is turned off, the controller 28*a* generates a rotation start signal and the pulse generator 28*b* generates a pulse S as shown in FIG. 9 according to this embodiment of the invention. Then the stepping motor 24 is rotated in response to the pulse S and stopped from rotating when the first detection member outputs a detection signal, whereby the position of each developing implement can be made known by letting the home position face the photosensitive drum 1.

As was described above, the control means in the developing-equipment switching apparatus according to the present invention causes the driving motor to rotate every integral number of times and sets the rotational ratio between the primary drive transmission member and the secondary drive transmission member in such a way that the rotary retainer rotates by a set angle between the adjoining developing implements when the driving motor is rotated the integral number of times or that the rotary retainer rotates by the set angle of the developing implement adjacent to a position in the reference state detected by the first rotation detecting means of the rotary retainer when the driving motor rotates the integral number of times. Therefore, the control means is required only to control the driving motor so as to rotate it every integral number of times, thereby the developing implements facing the latent image carrier can be switched or moved to the reference position. Therefore, the developing-equipment switching apparatus is produced less costly as it is capable of switching the developing implements quickly and simply.

Since the control means in the developing-equipment switching apparatus according to the present invention switches the developing implements facing the latent image carrier by rotating the driving motor every integral number of times, the rotor of the driving motor stands in the same relationship to the stator while any one of the developing implements is facing the latent image carrier. Therefore, the positional deviation of the developing implements from one to another caused by the static angular error of the rotary shaft of the stepping motor is obviated.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A developing-equipment switching apparatus comprising:

a rotatably-supported rotary retainer for holding a plurality of developing implements to make each developing implement face a latent image carrier when said rotary retainer rotates;

a driving motor for generating driving force;

control means for controlling the rotation of said driving motor;

a primary drive transmission member which is anchored to the rotary shaft of said driving motor and rotated with the rotary shaft; and a secondary drive transmission member which is anchored to and rotated with said rotary retainer, so that the developing implements are switched from one to another by transmitting the torque of said driving motor to said rotary retainer via said primary drive transmission member and said secondary drive transmission member to rotate said rotary retainer;

wherein said control means causes said driving motor to rotate every integral number of times and sets the rotational ratio between said primary drive transmission member and said secondary drive transmission member so that said rotary retainer rotates by a set angle between the adjoining developing implements when said driving motor is rotated the integral number of times.

2. A developing-equipment switching apparatus as claimed in claim 1, wherein said secondary drive transmission member in the form of a gear is integrally formed with said rotary retainer in the form of a discoidal flat plate with a plurality of teeth directly cut in a peripheral portion thereof.

3. A developing-equipment switching apparatus as claimed in claim 1, further comprising first rotation detecting means for detecting the rotation of said rotary retainer each time said rotary retainer turns once, wherein said control means controls said driving motor with a predetermined control sequence in a state in which said first rotation detecting means is detecting the rotation of said rotary retainer as a reference state.

4. A developing-equipment switching apparatus as claimed in claim 1, further comprising first rotation detecting means for detecting the rotation of said rotary retainer each time said rotary retainer turns once, second rotation detecting means for detecting the rotation of said driving motor each time said driving motor turns once and inconsistent-operation detecting means for receiving detection signals from said first and second rotation detecting means and deciding the presence of inconsistency unless said inconsistent-operation detecting means receives said detection signals in a predetermined timing relationship therebetween, whereby an inconsistent-time sequence is executed when said inconsistent-operation detecting means decides the presence of inconsistency.

5. A developing-equipment switching apparatus as claimed in claim 4, wherein said control means stops said driving motor in such a state that said first rotation detecting means has detected the rotation of said rotary retainer.

6. A developing-equipment switching apparatus as claimed in claim 3, wherein said control means is stored with color modes and executes a control sequence selected from among a plurality of sequences stored in line with each color mode.

7. A developing-equipment switching apparatus as claimed in claim 3, wherein said control means causes said driving motor to rotate every integral number of times and sets the rotational ratio between said primary drive transmission member and said secondary drive transmission member so that said rotary retainer rotates by the set angle of the developing implement adjacent to a position in the reference state detected by said first rotation detecting means of said rotary retainer when said driving motor rotates the integral number of times.

* * * * *